United States Patent [19]

Chaleat et al.

[11] Patent Number: 4,818,279

[45] Date of Patent: Apr. 4, 1989

[54] METHOD AND DEVICE FOR THE GRANULATION OF A MOLTEN MATERIAL

[75] Inventors: Bernard Chaleat, Norcier; Philippe Vaxelaire, Ville La Grand, both of France

[73] Assignee: Extramet Industrie S.A., Bonne, France

[21] Appl. No.: 163,119

[22] PCT Filed: May 27, 1987

[86] PCT No.: PCT/FR87/00182

§ 371 Date: Feb. 11, 1988

§ 102(e) Date: Feb. 11, 1988

[87] PCT Pub. No.: WO87/07546

PCT Pub. Date: Dec. 17, 1987

[30] Foreign Application Priority Data

Jun. 13, 1986 [FR] France ..... 86 08543

[51] Int. Cl.[4] ..... B22F 9/08

[52] U.S. Cl. ..... 75/0.5 C; 75/0.5 B; 264/13; 425/6

[58] Field of Search ..... 425/6, 7, 8; 264/12, 264/13, 14; 75/0.5 C, 0.5 B

[56] References Cited

U.S. PATENT DOCUMENTS 1,395,442 11/1921 McGregor ..... 239/472

FOREIGN PATENT DOCUMENTS 0194847 9/1986 European Pat. Off. .
1268792 5/1968 Fed. Rep. of Germany .
348930 5/1905 France .
1125042 10/1956 France .

*Primary Examiner*—Wayland Stallard
*Attorney, Agent, or Firm*—Holman & Stern

[57] ABSTRACT

Granulation device comprising means for heating a material to be granulated in order to cause its melting and means for supplying the molten material to a container (1) terminated by an orifice (9) for spraying the material in the form of droplets at the entrance of a cooling housing wherein the droplets solidify into granules. Said container comprises on at least one portion of its inner wall raised helical elements imposing a helical blade-type circulation to the molten material, said helical elements (5,6,7) being comprised of grooves provided in a generally cylindrical part (4) which is housed without any clearance into a cylindrical portion of said container (1).

10 Claims, 2 Drawing Sheets

METHOD AND DEVICE FOR THE GRANULATION OF A MOLTEN MATERIAL

CROSS REFERENCE TO RELATED APPLICATION(S)

This United States application stems from PCT International Application No. PCT/FR87/00182 filed May 27, 1987.

The present invention relates to the field of granulation or in other words formation of spheroidal particles or solid granules from molten material and especially from a bath of molten metal, the granules being formed after solidification of said material.

The invention is more specifically concerned with a method for granulating metals or metal alloys from a mass of these materials in the molten state. In the present description, the notion of metal will also designate alloys of two or more metals as well as any mineral or organic compound containing a metal. However, it will be noted that the invention is also applicable to certain nonmetallic materials, the granulation of which gives rise to substantially the same problems as metals.

More specifically, the invention is directed to a method of granulation in which molten material is discharged in spray form and then solidified in the form of granules.

Various solutions have already been proposed for carrying out granulation of metals. Reference may be made to those described in German Pat. No. 1,268,792 and French Pat. No. 2,391,799 in which the molten metal is discharged in spray form by subjecting it to a movement of rotation which generates a centrifugal force. In these methods, rotation of the liquid metal is obtained under the influence of a rotating magnetic field produced by a stator surrounding a tube in which the liquid metal circulates. The stator has a bottom wall pierced by a calibrated orifice through which the metal is discharged in a conical spray sheet. Granules are accordingly formed by cooling in a suitable atmosphere.

It is clear that these devices and methods call for the use of costly equipment and that the process development involved is not always easy. These difficulties are more particularly related to the presence of rotating magnetic field generators which constitute potential sources of failure and represent additional costs if only in regard to power consumption costs. It is also necessary to determine the velocities of the rotating fields in order to obtain the best results but this preliminary adjustment is sometimes a difficult procedure.

Granulation of metals presents in addition a specific problem related to the presence of impurities, which often arises from a marked tendency towards oxidation. All the techniques applied to date, with or without rotating fields, have failed to solve this problem. Even if extreme purification of the metal is achieved immediately upstream of the spray atomization device, which complicates installations still further, randomly distributed particles of impurities are again found to be present in the droplets. These particles result in the formation of granules of variable size and composition, the shapes and surfaces of which are too irregular.

In order to achieve better granulation, the present invention proposes to carry out spray atomization by means of devices for subjecting the molten material to mechanical confinement in the form of helical streams as it flows towards the spray discharge orifice. Although devices of this type are already known per se for the purpose of spray delivery of water under pressure (usually 6 bar), it should be emphasized that they have never yet been considered as a solution to the problem stated earlier in relevant applications involving solidification of droplets from material which is liable to contain impurities.

Accordingly, the object of the invention is to provide a granulating device comprising means for feeding material into a container terminating in an orifice for spray discharge of material in the form of droplets at the inlet of a cooling enclosure in which the droplets solidify in the form of granules, characterized in that this container is provided on at least part of its internal wall with raised helical elements which cause the molten material to flow in the form of helical streams.

In a preferred embodiment of the invention, the helical elements aforesaid can consist of grooves formed in a cylindrical part which occupies a tubular portion of the container.

Provision can be made for two, three or a greater number of grooves which should nevertheless be preferably limited to five. As a general rule, three grooves would appear to be the most suitable number.

The container can therefore be constituted at this level by a cylindrical tube and the grooves can be cut in a removable member which also has a generally cylindrical shape and is fitted within said container with zero clearance. It is possible, however, to provide a container which has a different shape and which may have a certain degree of conicity, for example.

The container can advantageously terminate in an internal cone having a vertex angle which varies within the range of 30 to 90 degrees. The lower portion of said internal cone opens into the orifice of the container through which the molten material to be converted to granules or solid beads is intended to flow in a spray-discharge sheet. This discharge orifice virtually constitutes the vertex of the cone.

Under preferred conditions of practical execution of the invention and in particular for granulation of metallic materials, especially reactive and oxidizable metals such as calcium and magnesium, the diameter of the spray discharge orifice can be within the range of 1 to 5 millimeters with a length of 0.5 to 5 millimeters and the pitch of the grooves can be within the range of 10 to 50 millimeters. The number and cross-sectional area of the grooves are preferably chosen so as to ensure that the sum of cross-sectional areas for flow of molten material is at least equal to 2.5 times the cross-sectional area of the orifice. This ratio is advantageously within the range of 2.5 to 10 and preferably 3 to 5.

Moreover, the device in accordance with the invention is advantageously provided with means for applying an adjustable pressure to the material which is fed to the container, this pressure being within the range of 1 to 3 bar under the most suitable conditions.

In the application of the invention to the means of the device aforesaid, adjustment of this pressure makes it possible to determine the rotational velocity imparted to the flow of material by the helical flow path and consequently the particle size of the beads obtained after solidification. It is thus possible to displace the particle-size spectrum, for example between 200 to 1000 microns, 500 to 1800 microns, 1000 to 2500 microns in the case of calcium or magnesium. However, very fine particles (smaller in size than 50 microns) are never manufactured simultaneously since they would be highly dangerous in the case of these reactive metals.

It will be noted that the technique proposed by the invention dispenses with the need for any operation which consists in washing the calcium or magnesium with fused mineral salts. The high speed of rotation, the absence of a filter, the absence of dead points in the circulation of molten metal: all these considerations lead to the result that the oxides in suspension cannot settle. The suspension remains homogeneous up to the final point within the solidified granules. Furthermore, the material discharged from a cone terminating in a single orifice forms a frustoconical film which flares out and breaks up in the form of droplets, which ensures a satisfactory filling ratio in the case of the cooling enclosure and is conducive to rapid and homogeneous solidification.

An additional element which it often proves useful to take into consideration concerns the material used for the spray discharge nozzle and therefore the orifice, the grooved internal member and the container, at least in regard to the surfaces which are in contact with the molten material to be granulated. The respective surface tensions in fact govern the thickness of the fluid films which affects the final size of the manufactured granules. In the case of reactive metals, spray atomization takes place in an inert medium consisting of a rare gas such as helium or argon. Molybdenum accordingly appears to be the most suitable material for the mechanical parts used in the spraying process, particularly as it is not sensitive to wear in the course of time.

There will now be described in greater detail a particular embodiment of the invention which will serve to gain a more complete understanding of the essential features and advantages offered. It should be understood, however, that this embodiment is chosen by way of example and is not given in any limiting sense. The following description is illustrated in the accompanying drawings, in which.

Figure 1:
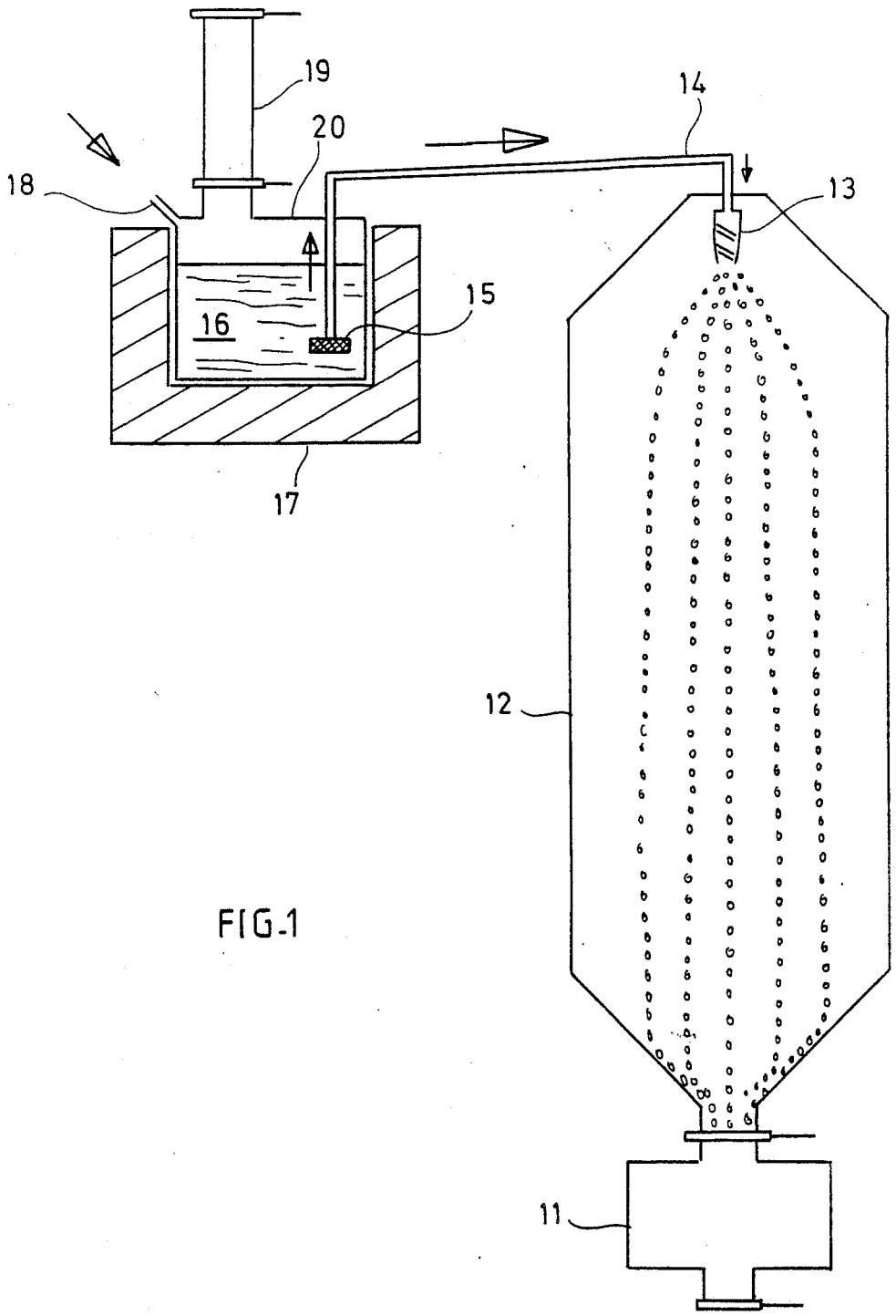
FIG. 1 shows the granulating device as a whole.

In accordance with FIG. 1, the granulating device comprises a cooling enclosure 12 in which is carried out the solidification of the droplets of molten metal formed at the outlet of a spray atomization device 13. The enclosure 12 is in the form of a vertical tower and the spray-atomization vortex device 13 is located at the top of the tower. Said enclosure is filled with a neutral gas such as argon in order to permit granulation of reactive metals such as calcium and magnesium. At its lower end is located a lock-chamber 11 from which are withdrawn the granules or beads thus obtained. Molten metal is supplied from a furnace 17 via a pipe 14 to the spray atomization device 13. Said furnace contains the mass of molten metal 16 within a leak-tight cell 20. The metal is withdrawn from the cell through the pipe 14 which dips into said mass of molten metal, via a filter 15.

The leak-tight cell 20 is connected to this lock-chamber 19 from which solid metal is supplied. It is also connected to a pipe 18 for the supply of gas. The gas admitted is a neutral gas and more particularly argon. Said gas fills the cell 20 above the molten mass 16 and exerts on this latter a pressure which can be adjusted to a value between 1 and 3 bar according to the desired particle size of the end product.

Figure 2:
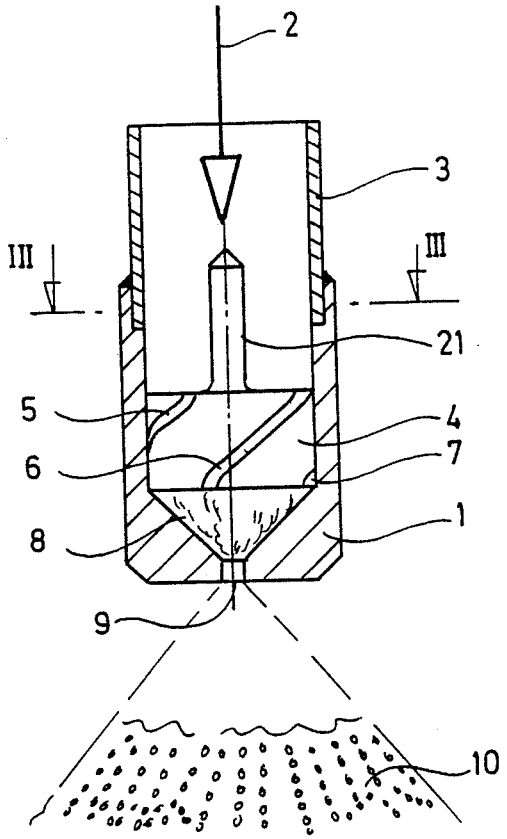
FIG. 2 is a sectional view of the spray atomization device.
Figure 3:
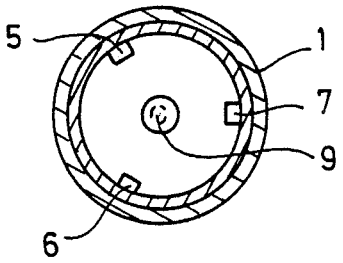
FIG. 3 is a top view of FIG. 2.

The device 13, which has the function of spray discharge of molten metal by means of a vortex effect, is illustrated in FIGS. 1 and 2.

In FIG. 2, there is shown a container 1 which has a generally cylindrical shape or in other words in which at least the upper internal portion is cylindrical. The molten metal is admitted into the container in the direction of the arrow 2 via a tube 3 which is welded to the container 1. Said tube forms a vertical extension of the pipe 14 of FIG. 1.

A member 4 having a cylindrical transverse cross-section is tightly fitted within the bottom portion of the container 1 and is provided with three helical grooves 5, 6, 7 cut in its internal walls and each having a rectangular cross-section. This member is removably mounted within the container 1. It is provided with an axial stud 21 which makes it possible to withdraw it easily.

The container 1 terminates in a bottom end cone 8, the downwardly directed vertex of which has its opening in the calibrated orifice 9 which is provided in the lower portion of the container 1. The vertex angle of said cone is usually within the range of 30 to 90 degrees and preferably of the order of 45 degrees.

When the molten metal under pressure arrives at the level of the member 4, it begins to flow in rotational motion as a result of the mechanical action exerted by the helical grooves 5, 6, 7 which cause said molten metal to flow in helical streams solely within the passages formed by said grooves between the member 4 and the internal wall of the container.

At the level of the cone 8, and by virtue of the shape of this cone, the rotational flow motion (vortex) accelerates and the liquid material forms a frusto-conical film before escaping through the orifice 9 in the form of a sheet 10 which is usually hollow. In this sheet, which is of frusto-conical shape, the flowing fluid breaks up into droplets and flares out within the cooling enclosure. This is due to a convergent-divergent effect at the level of the orifice 9 which in turn arises from the fact that the liquid is applied against the cone 8 under the action of centrifugal force and forms a hollow frusto-conical film within which a partial vacuum is created.

In a particular example of practical application of the invention, good results have been obtained with reactive metals (calcium and magnesium) by adopting a groove pitch of approximately 15 millimeters, these grooves being such as to have a rectangular cross-section of 5 to 6 $mm^2$. The outlet diameter of the orifice 9 was of the order of 2 to 4 millimeters or in other words sufficiently large to meet particle size requirements in regard to both the droplets and the beads obtained by solidification of the droplets. This had the effect of significantly if not totally removing the possible danger of clogging of the device. This constitutes a very appreciable advantage over the solutions proposed in the prior art which consisted in passing the molten metal through calibrated orifices since, by reason of the small diameter of these latter, these devices exhibited a strong tendency to clog or choke up.

By adopting the parameters given in the foregoing, it has been possible to obtain metallic beads or granules having a diameter within the range of 0.5 to 1.5 mm, which achieves satisfactory homogeneity.

In a more specific example, the process was performed on fused calcium at 870° C., with solidification by cooling to the ambient temperature of the workshop. The spray atomization device was provided with a cone 8 having an internal angle of 45 degrees, with an orifice 9 having a diameter of 2.6 mm and a height of 4 mm, and with a central member 4 having three grooves with a cross-section of 2.45×2.50 mm. Under these conditions, the ratio R of the sum of cross-sectional areas of the grooves to the cross-sectional area of the orifice is equal to 3.66. The central member and the container were formed of molybdenum.

With a supply pressure of liquid calcium of 2 bar, there was obtained a production of 165 kg per hour of beads 0.75 mm in diameter with a particle size distribution corresponding to 85% by weight of beads of 0.2 to 1 mm in diameter and 15% by weight of beads of 1 to 1.3 mm in diameter.

By operating in the same manner on magnesium and after replacing the central member by a member having two grooves with a cross-section of 2.9×3 mm (resulting in a ratio R of 3.41), the beads thus obtained had a mean diameter of 0.42 mm, with 92% by weight between 0.2 and 1 mm and 8% by weight between 0.2 and 0.1 mm.

Naturally, the foregoing description does not imply any limitation. It should be noted in particular that the raised helical elements provided within the container in order to impart rotational flow motion to the liquid material and to produce a vortex effect can assume shapes other than grooves formed in the container or in a part added within this latter in the manner indicated earlier. Instead of forming hollow profiles such as grooves within the container, it would also constitute a feasible solution to provide profiles which are also of helical shape but form projections within the container. This also has the effect of imparting rotational flow motion to the molten metal treated by the vortex effect. Although equally conducive to the formation of granules, it has become apparent, however, that this solution is less satisfactory.

Moreover, the geometrical arrangements and dimensions employed in the foregoing examples are those illustrated in FIG. 2 with a cylindrical member 4, the lower end section of which occupies the base of the cone 8, the diameter of this cylindrical member being 18 mm and its length being 15 mm. In this respect, it may be stated in more general terms that members of this type and designed for use in accordance with the invention advantageously have a diameter within the range of 10 to 30 mm and a length within the range of 10 to 40 mm.

We claim:

1. Granulating device comprising means for heating and melting material to be granulated and means for feeding molten material into a container terminating in an orifice for spray discharge of the material in the form of droplets at the inlet of a cooling enclosure in which the droplets solidify in the form of granules, characterized in that said container is provided on at least part of its internal wall with raised helical elements which cause the molten material to flow in helical streams.

2. Device according to claim 1, characterized in that said helical elements consist of grooves formed in a member having a generally cylindrical shape and fitted with zero clearance within a cylindrical portion of said container.

3. Device according to claim 1, characterized in that said member is removable and interchangeable.

4. Device according to claim 1, characterized in that said container terminates in an internal cone having an angle of the order of 30 to 90 degrees, the vertex being said orifice.

5. A device according to claim 4, characterized in that the bottom portion of said cone opens into the orifice of said container at the top of a cooling tower in which the formed droplets fall under the action of gravity and are cooled.

6. Device according to claim 5, characterized in that the diameter of the spray discharge orifice is within the range of 1 to 5 millimeters with a length of 0.5 to 5 millimeters and that the pitch of the grooves is within the range of 10 to 50 millimeters.

7. Device according to claim 2, characterized in that the number and cross-sectional area of the grooves are such that the sum of cross-sectional areas for flow of molten material is at least equal to 2.5 times the cross-sectional area of the orifice (9), this ratio being advantageously within the range of 2.5 to 10 and preferably 3 to 5.

8. Device according to claim 1, characterized in that it comprises means for applying an adjustable pressure to the material fed to the container, this pressure being preferably within the range of 1 to 3 bar.

9. Device according to claim 2, characterized in that, for the granulation of reactive metals, said container and said member are of molybdenum.

10. Method of making solidified granules of reactive metals having predetermined dimensions by using a granulating device comprising means for heating and melting the metal to be granulated and means for feeding molten metal into a container terminating in a orifice for spray discharge of the metal in the form of droplets at the inlet of a cooling enclosure in which the droplets solidify in the form of granules and means for applying an adjustable pressure to the metal fed to the container, characterized in that said container is provided on at least part of its internal wall with raised helical elements which cause the molten metal to flow in helical streams.

* * * * *